US005431262A

United States Patent [19]

Rekuc et al.

[11] Patent Number: 5,431,262

[45] Date of Patent: Jul. 11, 1995

[54] COMBINED ROLLABLE CASE AND CARRIER

[75] Inventors: Richard J. Rekuc, Pattenburg; James O'Shea, Annandale, both of N.J.

[73] Assignee: Royalox International, Inc., Phillipsburg, N.J.

[21] Appl. No.: 133,469

[22] Filed: Oct. 8, 1993

[51] Int. Cl.[6] ..... A45C 5/14; A45C 13/26; A45C 13/36; A45C 13/38

[52] U.S. Cl. ..... 190/18 A; 190/39; 190/102; 190/115; 190/127; 16/115; 280/37; 280/655.1; 280/47.29; 280/47.315

[58] Field of Search ..... 190/18 A, 18 R, 39, 190/115, 102, 127; 280/47.29, 655, 655.1, 37, 47.371, 47.315; 16/115

[56] References Cited

U.S. PATENT DOCUMENTS

| | | | |
|---|---|---|---|
| 3,566,436 | 3/1971 | Marks et al. | 16/115 |
| 3,960,252 | 6/1976 | Cassimally | 190/18 A |
| 4,261,447 | 4/1981 | Arias et al. | 280/47.29 X |
| 4,538,709 | 9/1985 | Williams et al. | 190/18 A |
| 4,618,035 | 10/1986 | Mao | 190/18 A |
| 4,743,038 | 5/1988 | Myers et al. | 190/18 A X |
| 4,890,705 | 1/1990 | Pineda | 190/110 X |
| 5,108,119 | 4/1992 | Huang | 280/37 |
| 5,167,306 | 12/1992 | Carrigan, Jr. | 190/115 |
| 5,291,976 | 3/1994 | Ku | 16/115 X |
| 5,295,565 | 3/1994 | Latshaw | 190/102 X |

*Primary Examiner*—Sue A. Weaver
*Attorney, Agent, or Firm*—Herbert Dubno

[57] ABSTRACT

An article of luggage has a handle received in a frame disposed along the interior rear wall of a flexible case to allow the article to be pulled along the ground or floor on wheels mounted in a wheel assembly affixed to the bottom of an article. The bottom plate has a pull-out ledge on which other luggage can be mounted and held in place by an elastic strap which is affixed to the case and can encircle the additional article or be buckled out of the way along the outer rear wall of the case.

9 Claims, 6 Drawing Sheets

COMBINED ROLLABLE CASE AND CARRIER

FIELD OF THE INVENTION

The present invention relates to an article of luggage and, more particularly, to a combined rollable case and luggage carrier.

BACKGROUND OF THE INVENTION

It has become a common practice to provide articles of luggage, whether or not they are provided with a rigid case or a case formed by a flexible material such as a fabric (soft case), with wheels enabling the article to be drawn along the ground or a floor surface.

For example, a valise can be provided with at least three and usually four wheels, casters or rolling bodies and with a strap or handle enabling the article to be drawn along a surface.

More recently, interest has developed in an article of luggage from which a handle can be extracted so that the article can be tilted to roll along a pair of wheels.

In addition, luggage carriers which may or may not be collapsible have been provided in which a pair of wheels are mounted upon a frame having a ledge upon which an article of luggage can rest and formed with one or more straps or other retainers for securing the article to the frame. Frequently, a handle can be pulled out of and at least partly retracted into the frame. Collapsible luggage carriers of this type are frequently used by aircraft travellers since the luggage carrier can be placed in an overhead compartment when collapsed. All of these prior systems have greatly facilitated the use of luggage by eliminating to a large extent the carrying burden theretofore placed upon the traveller.

Notwithstanding the success of such systems, various problems have been encountered. For example, soft case luggage of the type described may have insufficient structure to enable it to be easily packed and rolled about. Luggage carriers can be complex in construction and difficult to handle for at least some potential users.

OBJECTS OF THE INVENTION

It is therefore an object of the present invention to provide an improved article of luggage which obviates at least some of the aforementioned drawbacks and, especially, allows the advantages of a luggage carrier and a structured article to be obtained, even in the case of an article of luggage having a soft body.

Still another object of the invention is to provide a highly versatile roll-about article of luggage which can be manipulated more easily by the user, is sufficiently compact for use by aircraft travellers, and is capable of withstanding the rigors of repeated and long term use.

Yet another object of the invention is to provide an improved handle assembly for an article of luggage, especially for a so-called soft case article in which the walls of the case are composed of fabric.

SUMMARY OF THE INVENTION

We have found that the foregoing objects can be attained with an article of luggage which combines the advantages of a compact but rollable container with those of a luggage carrier. More particularly, a container body or case is formed, in accordance with the invention, with a wheel assembly extending along a rear and bottom wall of the case and a handle having shanks guided in a frame disposed along the rear wall and internally of the container body, the bottom of the case being provided with a rigid member from which a ledge can be extended to support another article, while a strap or other retainer, affixed to the container body, can be extended around this other article to hold it in place.

Specifically, an article of luggage according to the invention can comprise:

- a container body of a flexible material having a top wall, a bottom wall, a pair of opposite side walls and a rear wall, the front wall being provided with means for opening the body to afford access to an interior thereof;
- a wheel assembly extending across the rear wall adjacent the bottom wall and provided with two spaced apart wheels enabling rolling of the article along a surface upon tilting of the article rearwardly;
- means in the interior of the container including a frame along the rear wall imparting structure to the body, the frame having a pair of upwardly extending limbs; and
- a handle having shanks guided in the limbs and extendable upwardly from the frame at the top wall in an extended position to enable the article to be tilted and drawn along the surface, and telescoping into the limbs upon restoration of the handle to a retracted position.

A rigid member can be disposed outwardly of the container body or case along the bottom wall, the pull-out ledge being slidably received in this rigid member. According to an important feature of the invention, this rigid member simultaneously forms the plate whose wheel wells accommodate the rollers and thus is part of the wheel assembly. The pull-out ledge can be a U-shaped slide having a pair of parallel arms each guided in a respective channel formed in the rigid member and a cross piece interconnecting the arms.

The arms and the rigid member are formed with catches engaging the arms in fully retracted and fully extended positions of the U-shaped slide. The catches can be constituted by resilient fingers molded into the rigid member along slots in which lateral projections of the arms are guided.

According to another feature of the invention, the retainer is a stretchable web strap having a releasable buckle enabling the strap to be faced around the other article, e.g. an attache case, resting upon the ledge and secured by the strap at the front wall of the main luggage case. The strap is so positioned that, when it is relaxed, it can be buckled out of the way along the rear wall so as to allow access to the case through the front wall.

According to yet another feature of the invention, the frame has a pair of vertical limbs in the form of tubular extrusions in which the shanks of the handle are guided, these extrusions being formed with main channels of the same cross sectional shape as the shanks, e.g. circular cross sections, while auxiliary channels run parallel to the main channels and are connected thereto by slots. To prevent canting and twisting of the shanks and hence the handle, the shanks are provided with pins which extend through the respective slots and heads guided in the auxiliary channels. The auxiliary channels and their respective slots can have a T cross section.

According to a further feature of the invention, the frame also include rigid top and bottom members of molded plastic, like the aforementioned rigid member and an outer cap along the top wall from which the handle emerges, the top and bottom members conforming to the cap and the wheel supporting member, respectively, and being connected thereto through the fabric of the flexible case. The top and bottom members can be formed at their ends with respective sockets in which the extrusions are received and provided with clips engaging the pins of the shanks when the handle is fully retracted and fully extended, respectively. The assembly of top and bottom rigid members and extrusions thus provides a rigid frame structure which maintains the shape of the case alone or in conjunction with a stiff back disposed within the interior of the case along the rear wall and any interior rigid lining additionally provided along the top and side walls thereof.

BRIEF DESCRIPTION OF THE DRAWING

The above and other objects, features and advantages of the invention will become more readily apparent from the following description, reference being made to the accompanying highly diagrammatic drawing in which.

SPECIFIC DESCRIPTION

Figure 1:
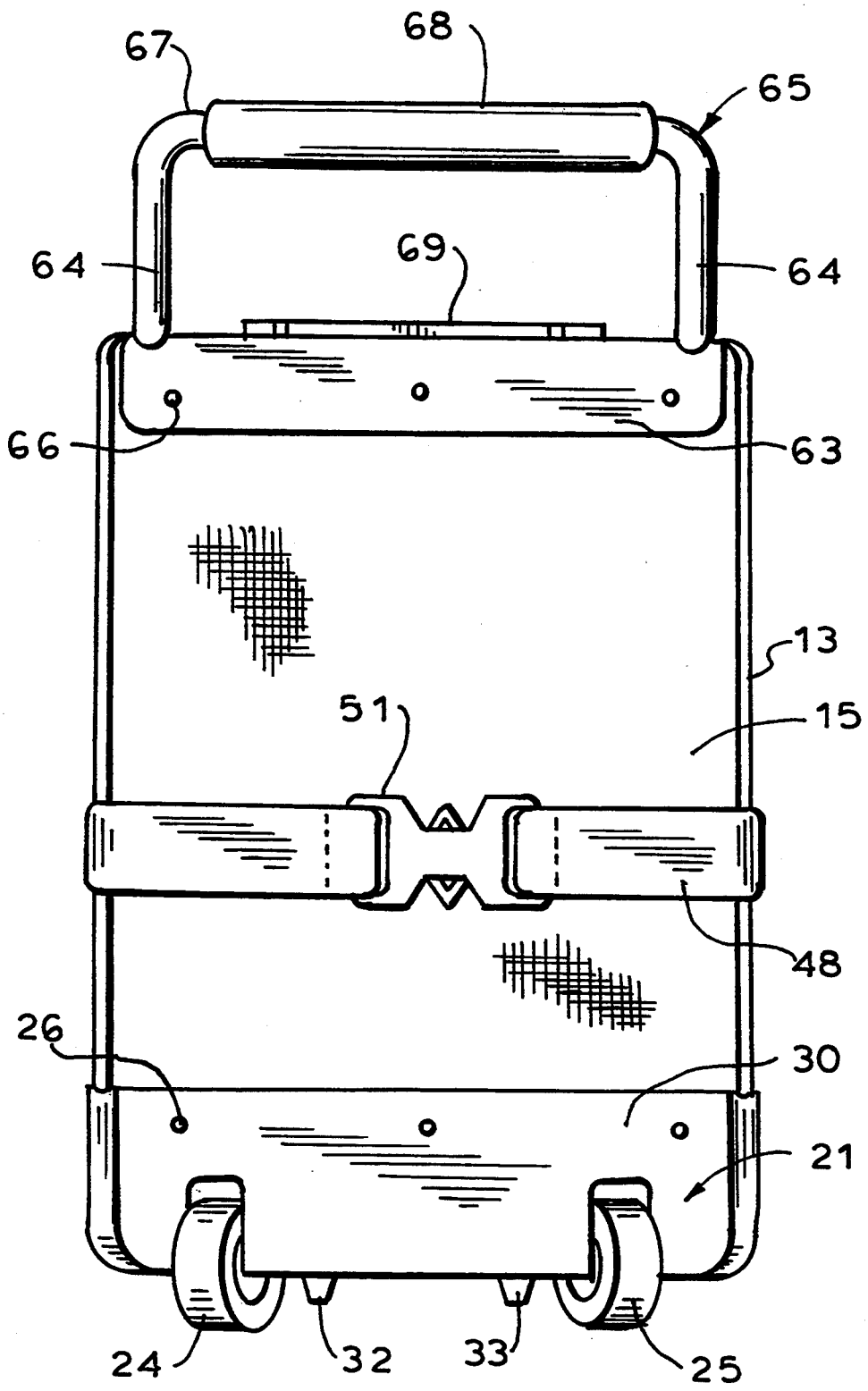
FIG. 1 is a rear view of the roll-about luggage article according to the invention.
Figure 2:
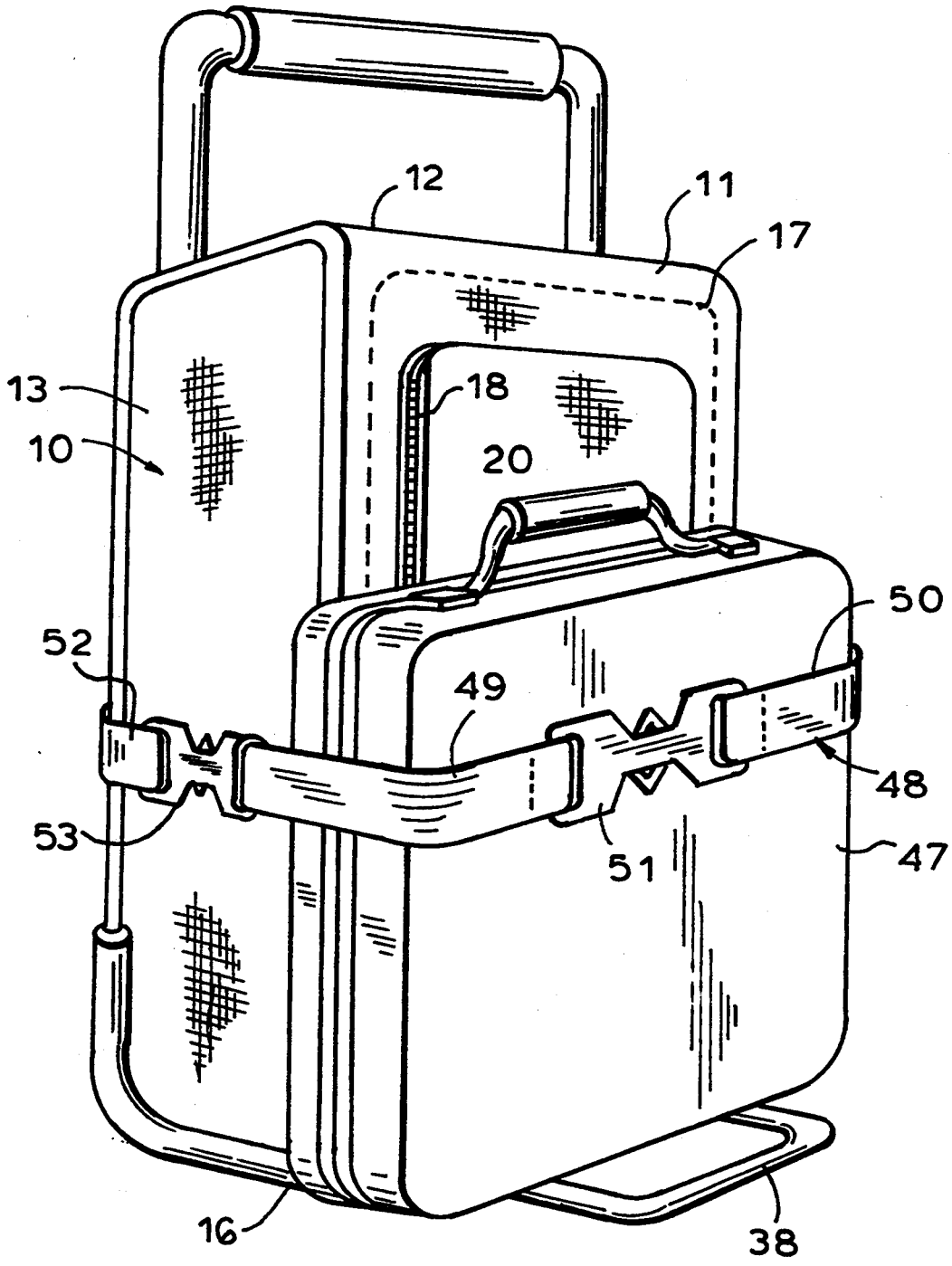
FIG. 2 is a perspective view showing the front thereof and illustrating an additional article on the pull-out ledge.
Figure 5:
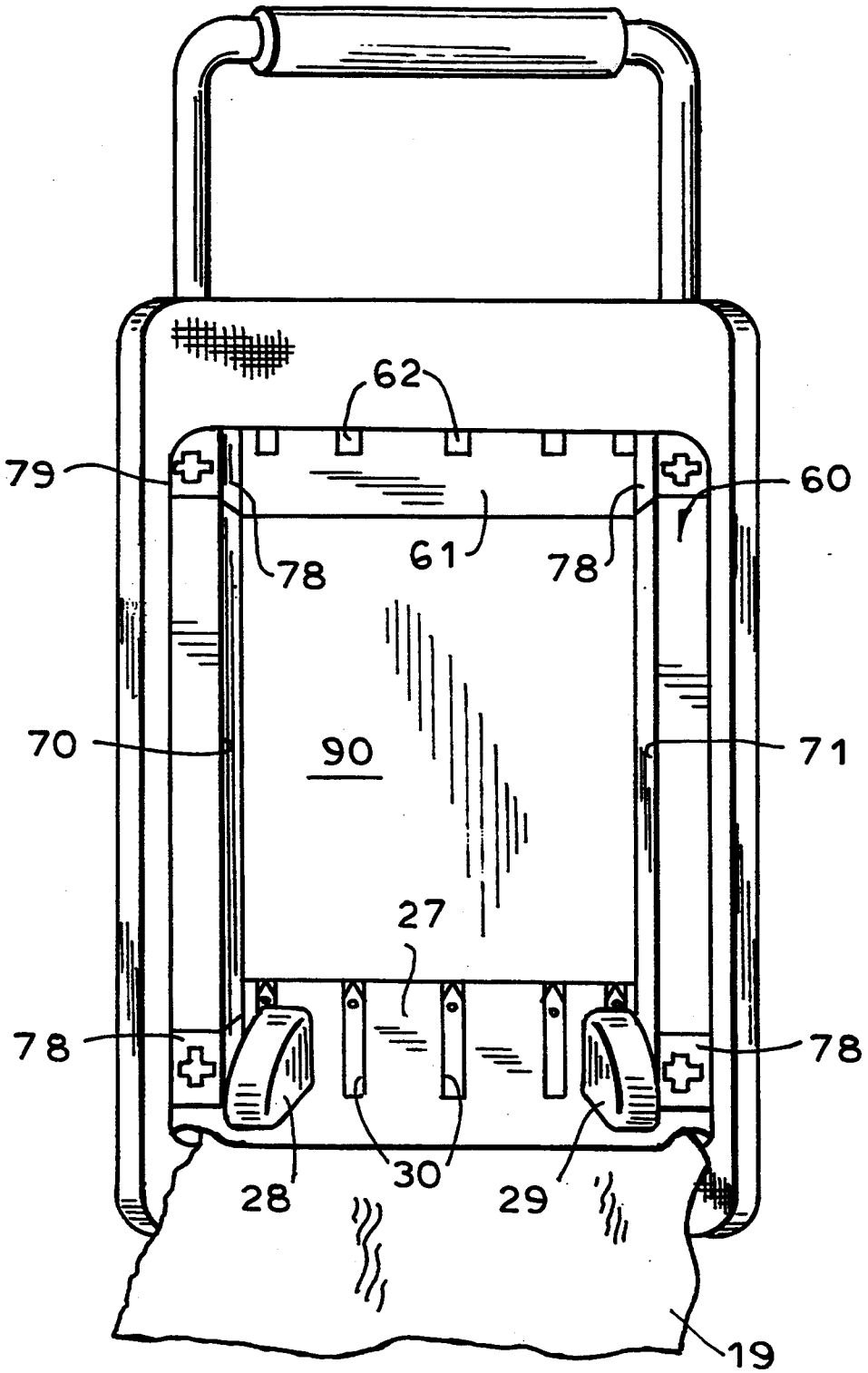
FIG. 5 is an elevational view illustrating the rear of the case as seen from the interior thereof.

As can be seen from FIGS. 1 and 2, for example, the rolling article of luggage can comprise a fabric case 10 having a front wall 11, a top wall 12, two side walls 13 and 14, a rear wall 15 and a bottom wall 16. The front wall may be provided with a slide fastener 17 or 18 enabling the front wall to be opened, e.g. by having a flat portion 19 thereof folded down (see FIG. 5) and which can additionally be formed with a slide fastener 20, for example, affording access to a pouch in the front wall if desired.

The article comprises a bottom plate 21 which can be molded from synthetic resin and is formed with a pair of wheel wells 22 and 23 in which respective wheels 24 and 25 are journalled on axles (not shown) and which is secured, e.g. by rivets or screws 26, through the rear wall 15 to an inner bottom plate 27 (FIG. 5) having wheel wells 28 and 29 corresponding to the wells 22 and 23. Ribs 30 can be provided on the inner plate 27 for stiffening same.

The plate 21 can have a portion 30 extending along the rear wall 15 and a further portion 31 lying along the bottom wall of the case 11.

Figure 3:
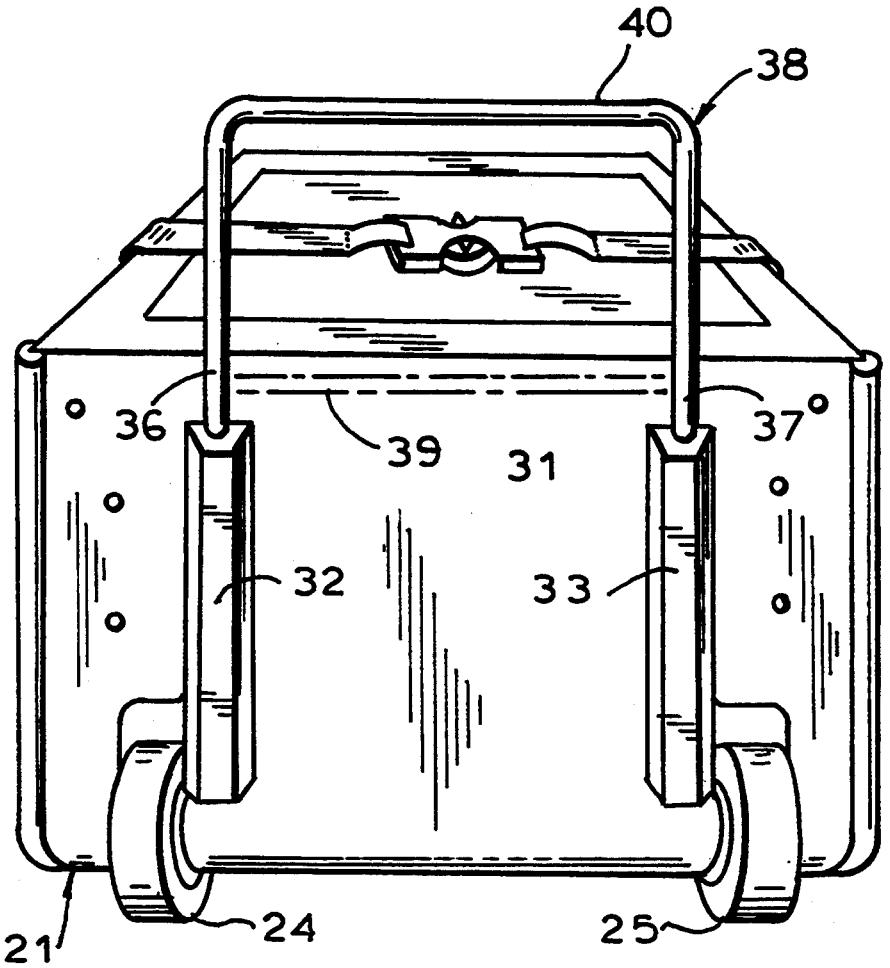
FIG. 3 is a perspective view of the article of luggage of FIGS. 1 and 2 from the bottom.
Figure 4:
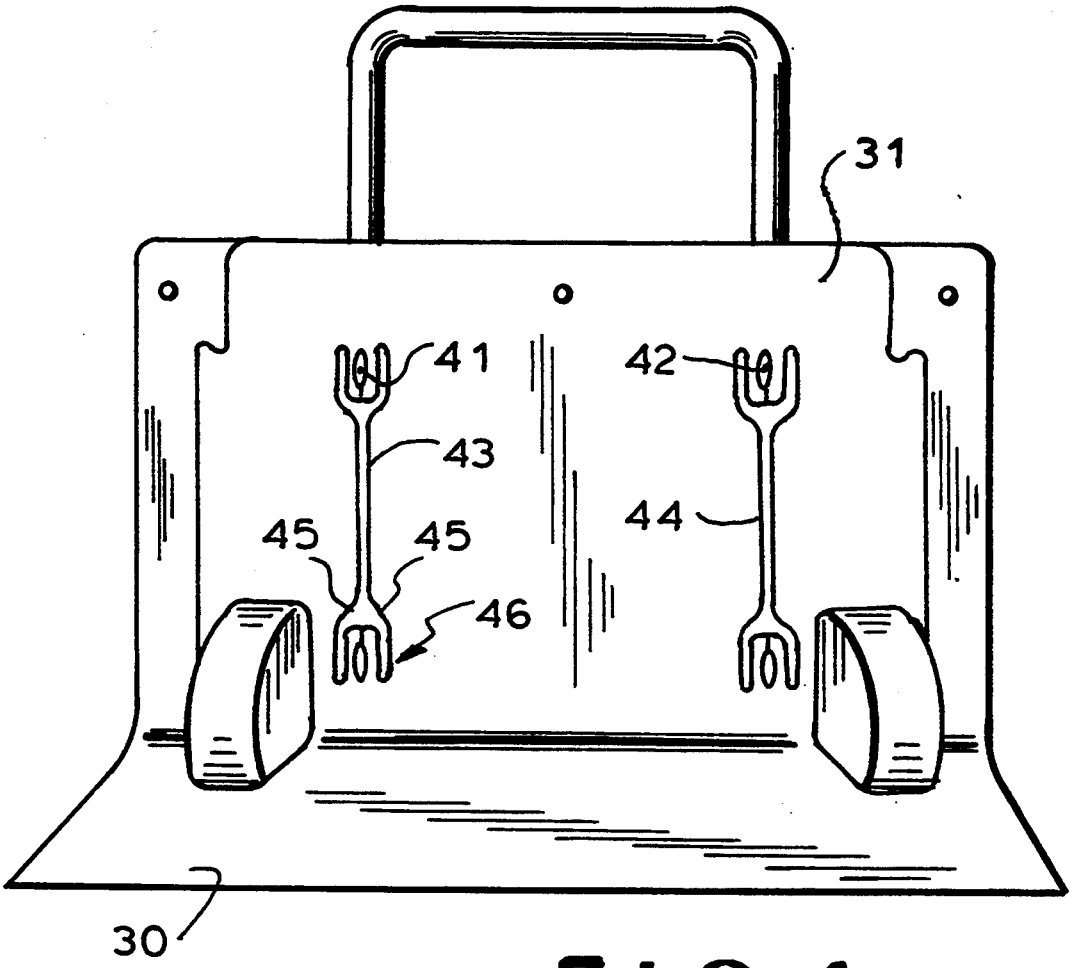
FIG. 4 is a plan view of the bottom plate of the article.

As will be apparent from FIGS. 3 and 4, the bottom portion 31 of the plate 21 which forms the wheel assembly with the wheels 24 and 25, is formed with two parallel ribs 32 and 33 of trapezoidal cross section and which form feet for supporting the case when it is in its upright position shown in FIG. 1, for example.

The ribs 32 and 33 form respective guide channels 34, 35 for the arms 36 and 37 of a U-shaped slide 38 constituting a pull-out ledge which is shown in its fully extended position in FIGS. 3 and 4. In its fully retracted position, represented at 39 in FIG. 3, the cross piece 40 of the pull-out slide lies inwardly of the front of the case. The arms 36 and 37 are formed at their ends with pins 41 and 42 which can ride in longitudinal slots 43 and 44 formed in the molded plate 21 and can be engaged by the resilient fingers 45 of respective catches 46 at each end of each of these slots so that the slide 38 can be retained in its fully retracted and in its fully extended positions until forced out of those positions manually and into the other position by the user.

As can be seen from FIG. 2, when the slide 38 is extended, another article such as an attache case 47 can rest upon this slide and can be secured by an elastic web strap or belt 48 whereby the rolling article can function as a luggage carrier for additional pieces of luggage.

The elastic web strap 48 can comprise two segments 49 and 50 which can be releasably joined by a buckle 51 and which can be secured at the side walls 13 and 14 of the case by, for example, additional straps 52 faced to the case and double D rings 53 connected to the segments 49 and 50.

In FIG. 3, the strap 48 is shown to be buckled in the front of the case. Additionally, however, when that strap is not used, it is buckled at the rear of the case across the rear wall 15 as has been shown in FIG. 1.

Figure 6:
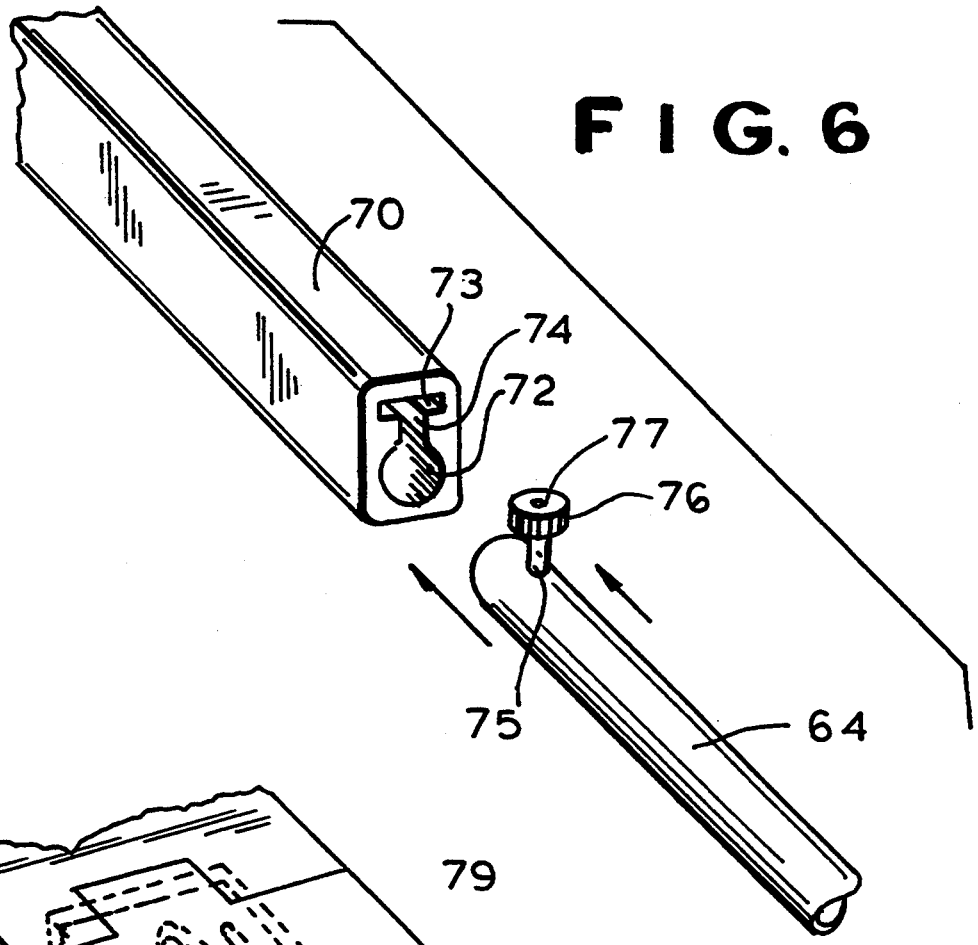
FIG. 6 is a perspective view diagramming the movement of the handle shanks relative to the extrusions.

The inner plate 27 forms the bottom rigid member of a frame 60 lending structure to the case and disposed within the interior thereof. That frame 60 further comprises a top rigid member or plate 61 which likewise can be molded with ribs 62 for stiffening purposes and is disposed along the top and rear walls, respectively, corresponding in shape to an outer cap 63 from which the shank 64 of a handle 65 can extend. The rigid cap 63, also of molded plastic, can be connected to the member 61 by rivets or screws as shown at 66 passing through the rear wall 15 of the case. Handle 65 can have a crossbar 67 surrounded by a sheath 68 of foam rubber or any other soft material. The handle otherwise is composed of a light metal, such as aluminum, and is of circular cross section. A carrier handle can be provided at 69 along the top wall of the case if desired, preferably forwardly of the pull-out handle 65 which is located substantially at the plane of the rear wall. The frame 60 also comprises two vertical limbs in the form of metal extrusions 70 and 71, e.g. of aluminum, which can have the construction shown for the extrusion 70 in FIG. 6.

More specifically, each extrusion 70, 71 can have a main channel 72 of circular cross section to receive the circular cross section of the respective shank 64 of the pull-out handle 65. Extending parallel to the main channel 72 is an auxiliary channel 73 of rectangular cross section and the two channels are interconnected by a continuous slot 74 through which a transverse pin 75 on the respective end of the shank 64 can pass. The pin 75 has a head 76 affixed thereto. The head can be attached to the pin via a screw thread or the head and pin can be attached to the shank 64 by a screw thread which can be released or tightened by a suitable wrench through an Allen socket 77 formed in the head.

Figure 9:
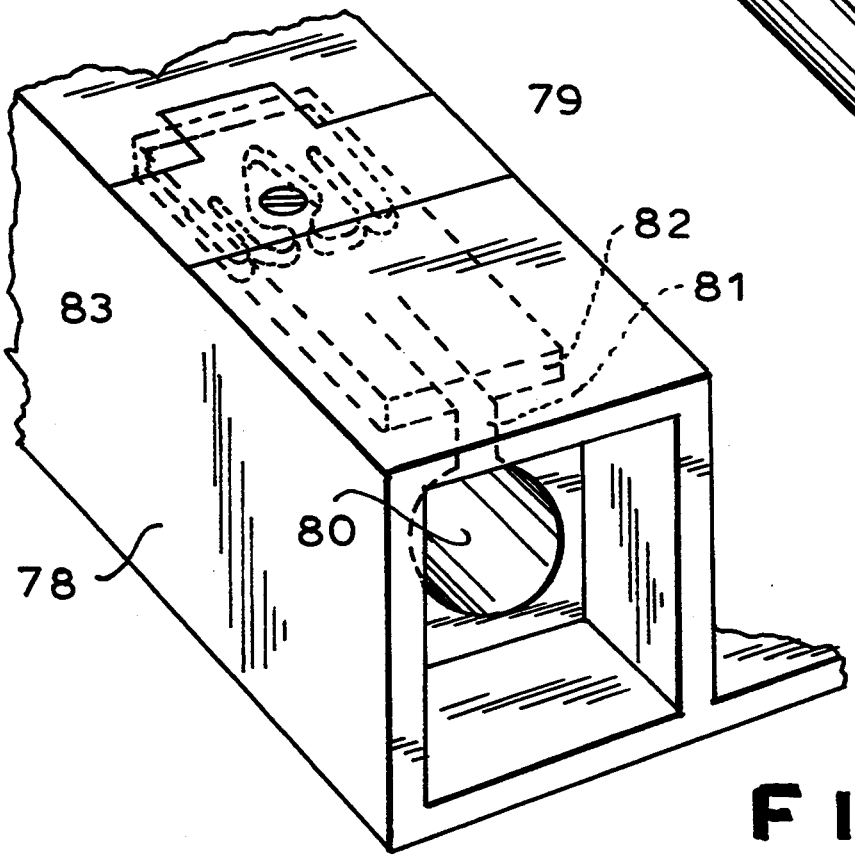
FIG. 9 is a detail of the socket at each end of each of the top and bottom rigid members of the frame.

The extrusion 70 and 71 are rectangular cross section and lie along the edges adjoining the rear and side walls of the case 11 and are received in respective sockets 78 molded into the plates 27 and 61 at the opposite ends thereof and shown in greater detail in FIG. 9. The sockets can form a force fit connection with the extrusions.

The sockets 78 are provided with windows 79 affording access to the Allen socket 77 connecting the head 76 and pin 75 with the shank 64. In addition, the socket 78 is molded with a bore 80 connected by a slot 81 to the rectangular cross section channel 82 so that the head and pin, upon passage of the pin into respective slot 81, can pass to the region of the window 79 at which a clip, e.g. of Celcon polyacetal, is mounted as represented at 83 in FIG. 9.

Figure 7:
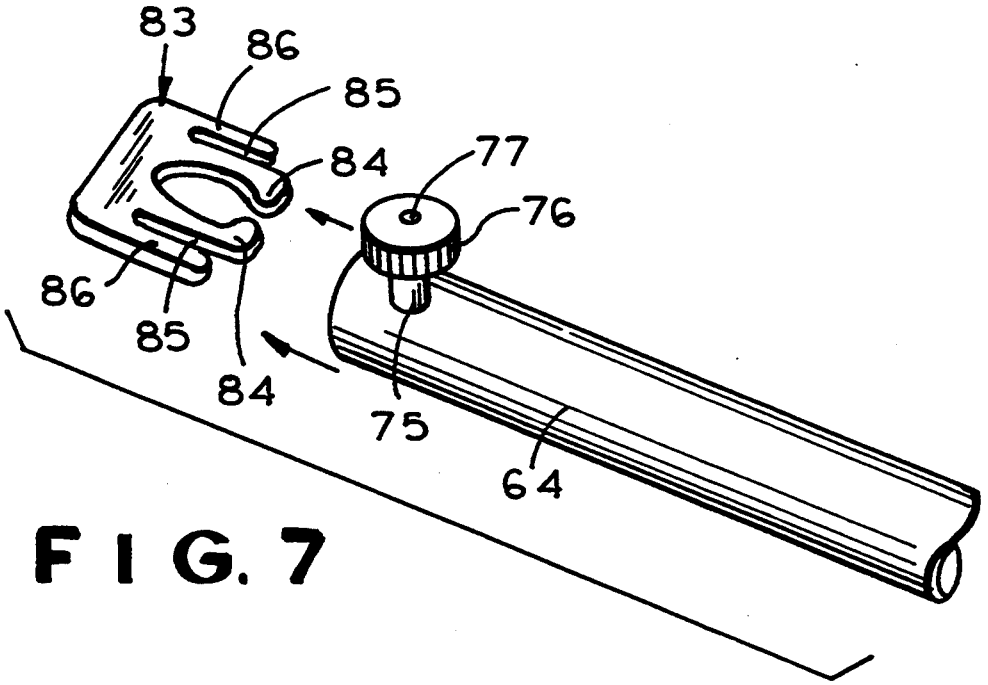
FIGS. 7 and 8 are perspective views illustrating the operation of the catches capable of retaining the handle in its upper extended and lower retracted positions.
Figure 8:
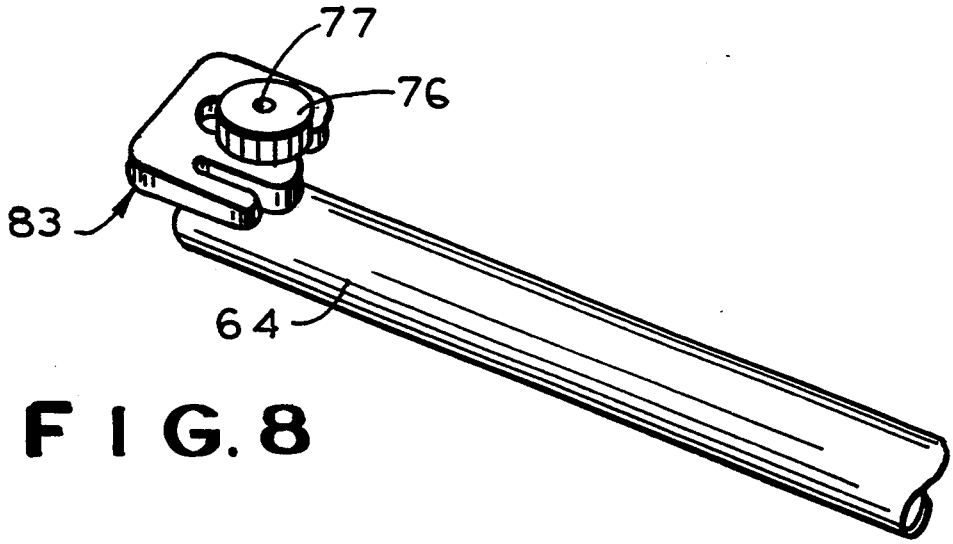

As a comparison of FIGS. 7 and 8 will show, the clips 83 each have a pair of fingers 84 adapted to engage around the respective pin 75 and the resiliency of which is increased by cuts 85 in the clip, separating these fingers from the sides 86 thereof. The clip is thus a low wear highly elastic detent for retaining the respective shank of the handle in its fully retracted or fully extended positions, respectively, depending upon whether the handle is pushed into the case or pulled out of it by the user.

Between the extreme positions, however, the handle is free to move and is not frictionally retarded and thus cannot maintain any intermediate position when released by the user.

The T shape of the auxiliary channel and slot 73, 74 of the extrusions 70, 71 constitute an antitorque guide in the plane of the handle 65 while dispensing the extrusions along the edges of the case as noted, allows the case to have a high interior capacity. The inner rear face of the case represented at 90 in FIG. 5 can be formed by a thin plastic sheet of greater stiffness than the fabric to facilitate use of this surface to accommodate articles which should remain smooth and unwrinkled upon packing.

We claim:

1. An article of luggage, comprising:

a container body of a flexible material having a top wall, a bottom wall, a pair of opposite side walls, a front wall and a rear wall, said front wall being provided with means for opening said body to afford access to an interior thereof;

a wheel assembly extending across said rear wall adjacent said bottom wall and provided with two spaced apart wheels enabling rolling of said article along a surface upon tilting of said article rearwardly;

means in the interior of said container including a frame along said rear wall imparting structure to said body, said frame having a pair of upwardly extending limbs; and a U-shaped handle having a bar and shanks perpendicular to said bark said limbs being formed with channels shaped to receive said shanks slidably whereby said shanks are guided in said limbs and said handle is extendable upwardly from said frame at said top wall in an extended position to enable said article to be tilted and drawn along said surface, and telescoping into said limbs upon restoration of said handle to a retracted position;

a rigid plate disposed outwardly of said container body along said bottom wall and formed with guide passages; and a pull-out ledge having rods slidably received in said guide passages of said rigid plate, said pull-out ledge being U-shaped slide having a pair of parallel arms formed by said rods and each guided in a respective one of said guide passage and a crosspiece interconnecting said arms, said rigid plate being formed with catches engaging said arms in fully retracted and fully extended positions of said U-shaped slide, said arms being formed with transverse projections engageable in longitudinal slots parallel to said arms and formed in said rigid plate said slots being in communication with said guide passages and in a vicinity of said arms, said catches being formed by resilient fingers unitary with said rigid plate and disposed along said slots.

2. The article of luggage defined in claim 1 wherein said guide passages are formed in ribs molded unitarily on said rigid plate and forming feet for said article.

3. The article of luggage defined in claim 1 wherein said rigid plate is a molded body forming part of said wheel assembly and provided with wells receiving said wheels.

4. The article of luggage defined in claim 1, further comprising a stretchable web strap affixed to said container body at a location intermediate said top and bottom walls and having a buckle enabling said strap to be fastened along said rear wall in an inoperative position and to be fastened around an article to be transported across said front wall, said article resting upon said ledge.

5. An article of luggage, comprising:

a container body of a flexible material having a top wall, a bottom wall, a pair of opposite side walls, a front wall and a rear wall, said front wall being provided with means for opening said body to afford access to an interior thereof;

a wheel assembly extending across said rear wall adjacent said bottom wall and provided with two spaced apart wheels enabling rolling of said article along a surface upon tilting of said article rearwardly;

means in the interior of said container including a frame along said rear wall imparting structure to said body, said frame having a pair of upwardly extending limbs; and a U-shaped handle having a bar and shanks perpendicular to said bar, said limbs being formed with channels shaped to receive said shanks slidably whereby said shanks are guided in said limbs and said handle is extendable upwardly from said frame at said top wall in an extended position to enable said article to be tilted and drawn along said surface, and telescoping into said limbs upon restoration of said handle to a retracted position, said limbs being constituted by tubular extrusions disposed along edges of said container body at which said side walls adjoin said rear wall, said frame comprising an upper molded member extending within the interior of said container body along said top wall, and a lower molded member extending within the interior of said container body along said bottom wall, said members having sockets at opposite extremities receiving ends of said tubular extrusions; and respective catches on said sockets engageable with said shanks of said handle for retaining said handle in fully extended and fully retracted positions, each of said channels including a main channel having a cross section corresponding to a cross section of a respective shank and receiving same, an auxiliary channel extending parallel to and alongside said main channel, and a slot connecting said channels, said shanks each having a transverse pin guided in the respective slot and a head formed on the pin and guided in the respective auxiliary channel, said auxiliary channel and said slot together defining a T-shaped cross section, said catches having resilient fingers engageable with said pins.

6. The article of luggage defined in claim 5 wherein each of said catches comprises a polyacetal clip having said resilient fingers engageable with one of said pins and received in a respective one of said sockets.

7. The article of luggage defined in claim 6 wherein each of said sockets is formed with a window aligned with the respective catch.

8. The article of luggage defined in claim 5 wherein said top member is affixed to an outer cap generally conforming to said top member and disposed along an exterior of said top wall, and said bottom member is affixed to a rigid molded body extending along said rear wall and said bottom wall and forming housings for said wheel and a part of said wheel assembly.

9. A handle assembly for an article of luggage, comprising:

a frame comprising a rigid top member, a rigid bottom member, and a pair of tubular extrusions, said members having sockets at opposite extremities receiving ends of said tubular extrusions;

a handle extendable from and retractable into said frame and including a pair of shanks respectively guided in said extrusions; and respective catches on said sockets engageable with said shanks of said handle for retaining said handle in fully extended and fully retracted positions, each of said extrusions being formed with a main channel having a cross section corresponding to a cross section of a respective shank and receiving same an auxiliary channel extending parallel to and alongside said main channel, and a slot connecting said channels, said shanks each having a transverse pin guided in the respective slot and a head formed on the pin and guided in the respective auxiliary channel, said auxiliary channel and said slot together being of T-shaped cross section, each of said catches comprises a polyacetal clip having resilient fingers engageable with one of said pins and received in a respective one of said sockets.

* * * * *